US006786689B2

(12) United States Patent
Dorris

(10) Patent No.: US 6,786,689 B2
(45) Date of Patent: Sep. 7, 2004

(54) LOW PROFILE DEADMAN AND METHOD FOR SHIPPING THE SAME WITH A TANK

(75) Inventor: Albert F. Dorris, Edina, MN (US)

(73) Assignee: Xerxes Corporation, Minneapolis, MN (US)

( * ) Notice: Subject to any disclaimer, the term of this patent is extended or adjusted under 35 U.S.C. 154(b) by 28 days.

(21) Appl. No.: 10/163,368

(22) Filed: Jun. 7, 2002

(65) Prior Publication Data

US 2003/0228201 A1 Dec. 11, 2003

(51) Int. Cl.[7] ..... B60P 7/06
(52) U.S. Cl. ..... 410/47; 410/33; 410/30
(58) Field of Search ..... 410/30, 47, 49, 410/50, 33, 31, 97

(56) References Cited

U.S. PATENT DOCUMENTS 3,727,795 A * 4/1973 Willsey ..... 220/530
4,051,570 A * 10/1977 Hilfiker ..... 14/26
4,906,137 A * 3/1990 Maloberti et al. ..... 405/224.3
6,345,933 B1 * 2/2002 Harding et al. ..... 405/53

OTHER PUBLICATIONS

"ZCL Installation Manual", ZCL Composites, Inc., Issue 5.00 99/02, (not dated).
"Tanks for Industrial, Fuel and Municipal Applications", Future Pipe Group (FPI), (not dated).
"FRP Accessory Products: Fiberglass Tanks Anchoring Systems from Containment Solutions", www.containmentsolutions.com/products/underground_frp/accessories/anchoring.html, web page printed Mar. 20, 2002.

* cited by examiner

*Primary Examiner*—D. Glenn Dayoan
*Assistant Examiner*—Hilary Gutman
(74) *Attorney, Agent, or Firm*—Piper Rudnick LLP; Steven B. Kelber

(57) ABSTRACT

A low profile deadman is shaped such that it can be placed alongside a storage tank on a conventionally-sized flatbed trailer. In one preferred embodiment, the deadman includes at least one chamfered edge.

16 Claims, 8 Drawing Sheets

LOW PROFILE DEADMAN AND METHOD FOR SHIPPING THE SAME WITH A TANK

BACKGROUND OF THE INVENTION

1. Field of the Invention

The invention relates to underground storage tanks generally, and more particularly to a deadman useful for anchoring an underground storage tank to prevent flotation and a method for shipping the deadman alongside a tank.

2. Discussion of the Background

Underground storage tanks (USTs) are commonly used for the storage of liquids, including gasoline, other petroleum products, and wastewater. These tanks are generally cylindrical in shape, with either curved (e.g., hemispherical) or flat ends. Underground storage tanks may be made of many materials, including steel and fiber reinforced plastic (referred to herein as FRP and fiberglass). Such tanks may be single or multi-walled. Such tanks often include ribs, which may be internal or external.

USTs are installed in a wide variety of locations and under a wide variety of conditions. In some locations, the water table is high enough such that some or all of the UST is below the water table. In these situations, a upward buoyant force will act on the tank. If the buoyant force exceeds the downward forces acting on the tank, the tank will 'float' up out of the ground (referred to herein as flotation). This situation is obviously undesirable.

One method commonly used to ensure that flotation does not occur is through the use of deadmen. Deadmen function as anchors to prevent flotation of the tank. Deadmen are typically installed in pairs with one deadman on each side of and in the plane of the bottom of the tank and are typically constructed of reinforced concrete. Deadmen are typically rectangular in shape and are typically 12 to 36 inches wide, 8 to 12 inches high, and usually have lengths equal to or greater than the corresponding tank. A detailed discussion of deadmen and their use in anchoring underground storage tanks can be found in co-pending U.S. application Ser. No. 09/657,807, filed on Sep. 8, 2000, entitled "Underground Storage Tank Buoyancy and Buoyancy Safety Factor Calculation Method and Apparatus," which is commonly owned by the assignee of the present application and which is hereby incorporated by reference herein.

Tanks are commonly attached to deadmen using straps. It is customary to provide a plurality of straps with one end of each strap connected to a deadman on one side of the tank, the other end of each strap connected to the deadman on the other side of the tank, and the straps passing over the tank such that the straps, in combination with the deadmen, prevent the tank from floating upward. Each end of a strap typically has a hook that is used to engage a loop, lug, anchor or eyebolt ("fastening loop" shall be used herein to refer to any of the foregoing or any other device that facilitates connection of a strap to a deadman) on the deadman. A detailed discussion of straps for use with deadmen can be found in co-pending U.S. application Ser. No. 10/135,367, filed on May 1, 2002, entitled "Tank Retaining System," which is commonly owned by the assignee of the present application and which is hereby incorporated by reference herein. As discussed in that application, each strap may comprise a pair of straps that are connected together by a tensioning device such as a turnbuckle, come-along, or other device. As used herein, a strap should be understood to refer to a single, continuous strap as well as a strap that is formed from two or more sections that are joined together either directly or indirectly through a tensioning or other device.

Shipping deadmen to an installation site can be expensive. USTs, especially those used for gasoline storage at service stations, are often constructed with a 10 foot diameter. On a conventional flat bed trailer, there is not enough room to place conventionally-shaped deadmen alongside a 10 foot diameter tank. This means that conventional deadmen must be shipped on a different section of the flat bed trailer from where the tank is located or that the deadmen must be shipped on a separate truck. In either situation, shipping cost is increased.

What is needed is an improved deadman that minimizes shipping costs while remaining economical and easy to use.

SUMMARY OF THE INVENTION

The present invention meets the aforementioned need to a great extent by providing a low profile deadman. In one aspect of the invention, the deadman is shaped such that it can be placed alongside a storage tank on a conventionally-sized flatbed trailer. In one preferred embodiment, the deadman includes at least one chamfered edge.

DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION OF THE PREFERRED EMBODIMENTS

The present invention will be discussed with reference to preferred embodiments of deadmen and methods of shipping such deadmen with underground storage tanks. Specific details, such as specific materials and dimensions, are set forth in order to provide a thorough understanding of the present invention. The preferred embodiments discussed herein should not be understood to limit the invention.

Figure 1:
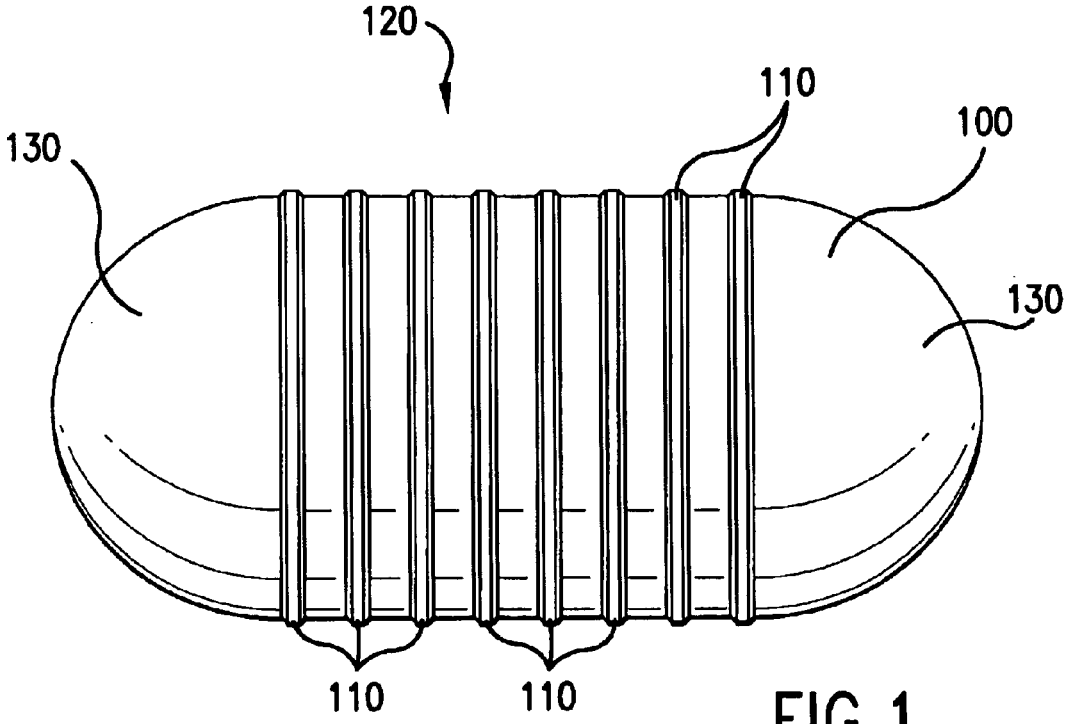
FIG.1 PRIOR ART
FIG. 1 is a side view of a prior art underground storage tank.

Referring now to the drawings, wherein like reference numerals designate identical or corresponding parts throughout the several views. A side view of a conventional underground storage tank (UST) 100 is shown in FIG. 1. The UST 100 includes a generally cylindrical center section 120 with dome shaped ends 130. The particular UST 100 illustrated in FIG. 1 includes a plurality of external ribs 110. Although the invention will be discussed in connection with its use with a UST having external ribs, it should understood that the invention may be used with other types of USTs with or without external ribs.

Figure 2:
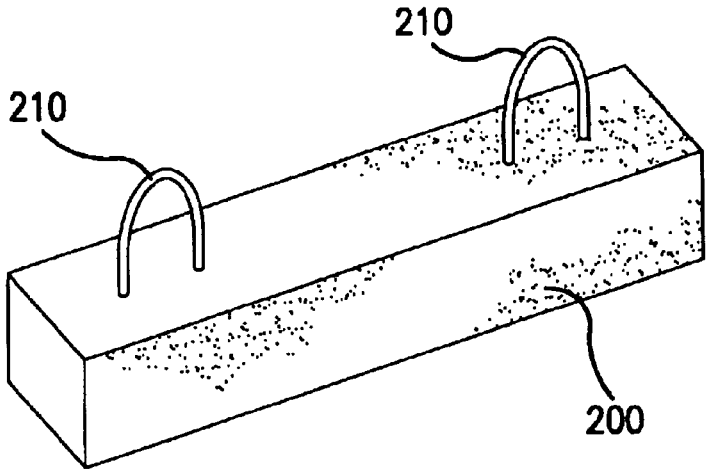
FIG.2 PRIOR ART
FIG. 2 is a perspective view of a prior art deadman.

FIG. 2 is a perspective view of a conventional deadman 200. The deadman 200 has a rectangular cross sectional shape. The height and width of the deadman 200 is typically between 12" and 18." The length of the deadman 200 typically matches a tank with which the deadman is to be installed. The deadman 200 is typically constructed from concrete according to ACI (American Concrete Institute) standards. The deadman 200 includes a "fastening loop" 210 that is cast with the deadman.

Figure 3:
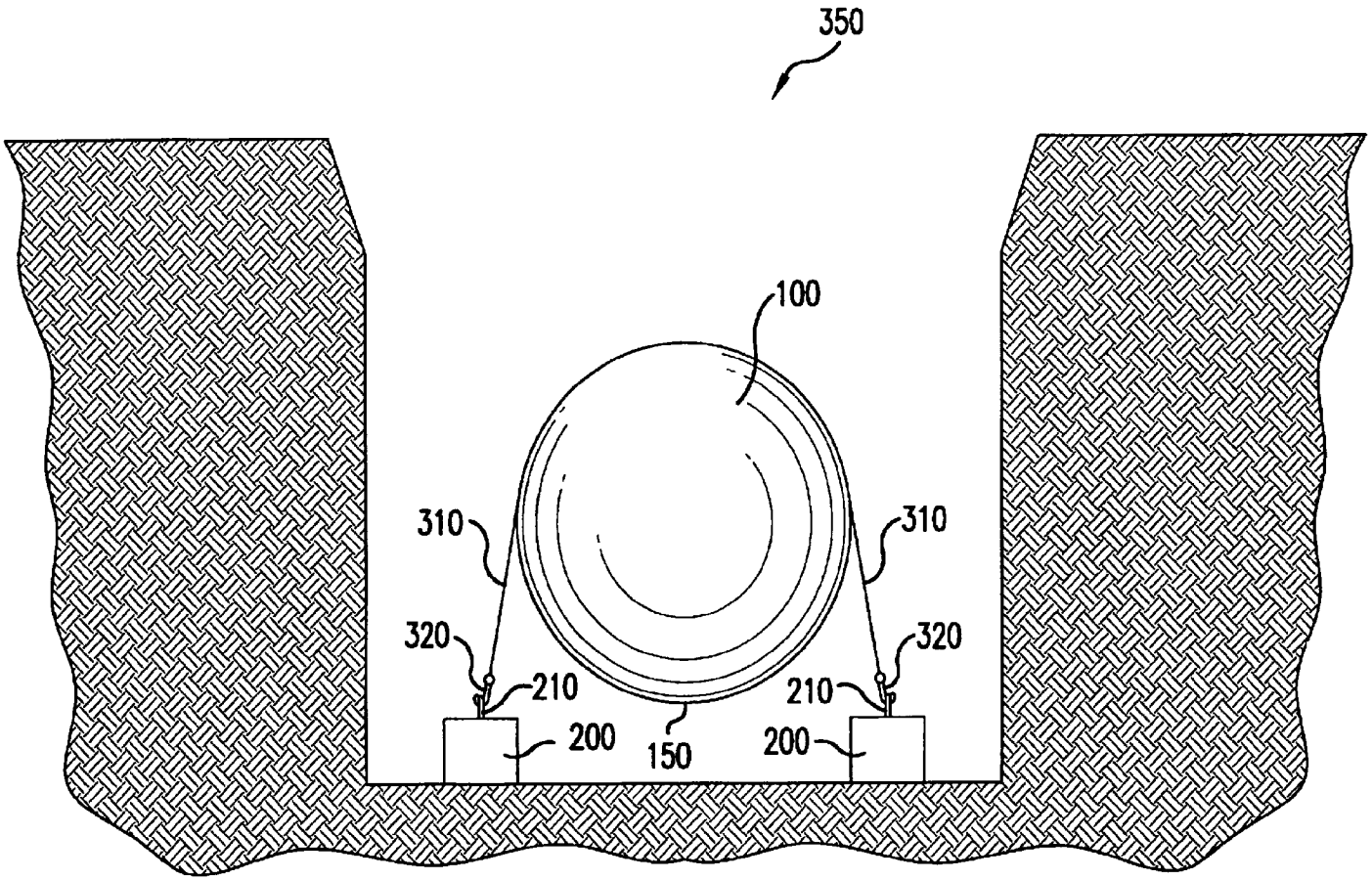
FIG.3 PRIOR ART
FIG. 3 is an end view of a prior art underground storage tank installation site in which the deadman of FIG. 3 is employed.

FIG. 3 illustrates a typical installation of a tank 100 using conventional deadmen 200. Typically these would be poured/cast in place or cast off-site but close by of course. They must be cured at least 7 days and in some cases 28 days to be fully effective. The deadmen 200 are typically beneath the lower surface 150 of the tank 100, although this may not be necessary in all cases. Straps 310 are connected to the "fastening loops" 210 of the deadmen 200 by hooks 320. In practice, a plurality of straps 310 are used along the length of the tank 100. The pit 350 is often backfilled with pea gravel (not shown in FIG. 3).

Figure 4:
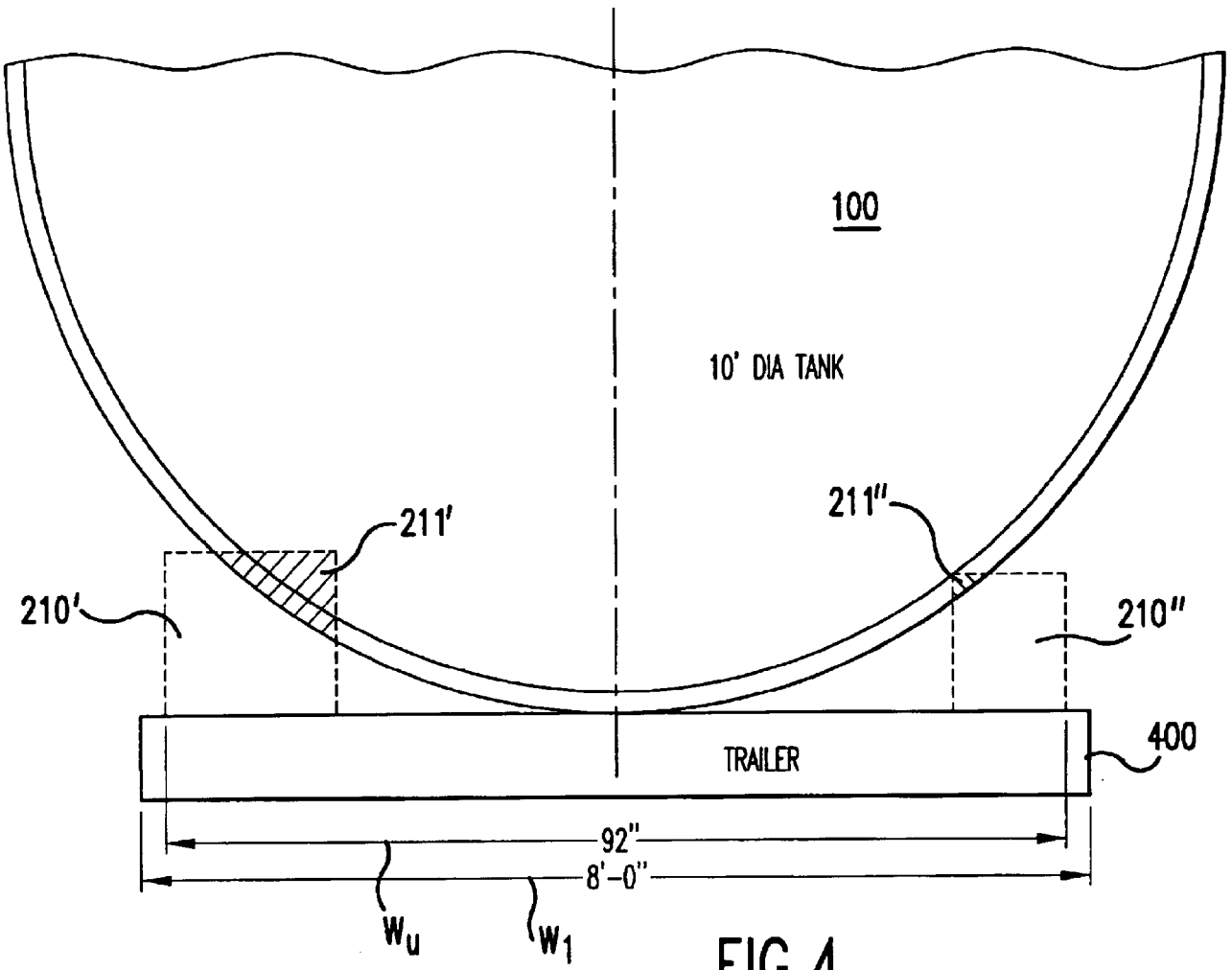
FIG.4 PRIOR ART
FIG. 4 is a schematic end view of the storage tank of FIG. 1 loaded on a conventional flatbed trailer.

USTs are used throughout the United States. For example, USTs are often used in gasoline filling stations to store gas underground. It will be readily appreciated that shipping costs for a UST can be substantial. It is becoming increasingly common in the UST industry, to minimize open hole construction time, for UST suppliers to supply deadmen as well as USTs to customers. This requires, of course, that the deadmen as well as the USTs be shipped to the installation site. One problem with prior art deadmen is that they cannot be shipped alongside 10 foot diameter tanks (an increasingly a popular size because of its larger volume) on a standard flatbed trailer. Referring now to FIG. 4, a standard flatbed trailer in the U.S. has a 96" (8 feet) wide $W_1$. Some truck drivers will require that at least 2" from each edge of the trailer be left free from cargo, so that chocking stakes may be installed on the trailer. In this situation, the usable width $W_u$ of the trailer is actually only 92." When a 10 foot diameter tank 100 is placed on a flatbed trailer 400 as shown in FIG. 4, there is insufficient room to place a conventional, rectangular cross section, deadman on the trailer. For example, FIG. 4 shows a conventional deadman 210' with an 18" square cross section in phantom. As indicated by the cross-hatched area 211', the upper right corner of the deadman 210' prevents the deadman 210' from being placed on the flatbed trailer 400. Similarly, a deadman 210" with a 12" square cross-sectional shape, again shown in phantom in FIG. 4, also experiences the same problem as indicated by the cross-hatched area 211".

Figure 5:
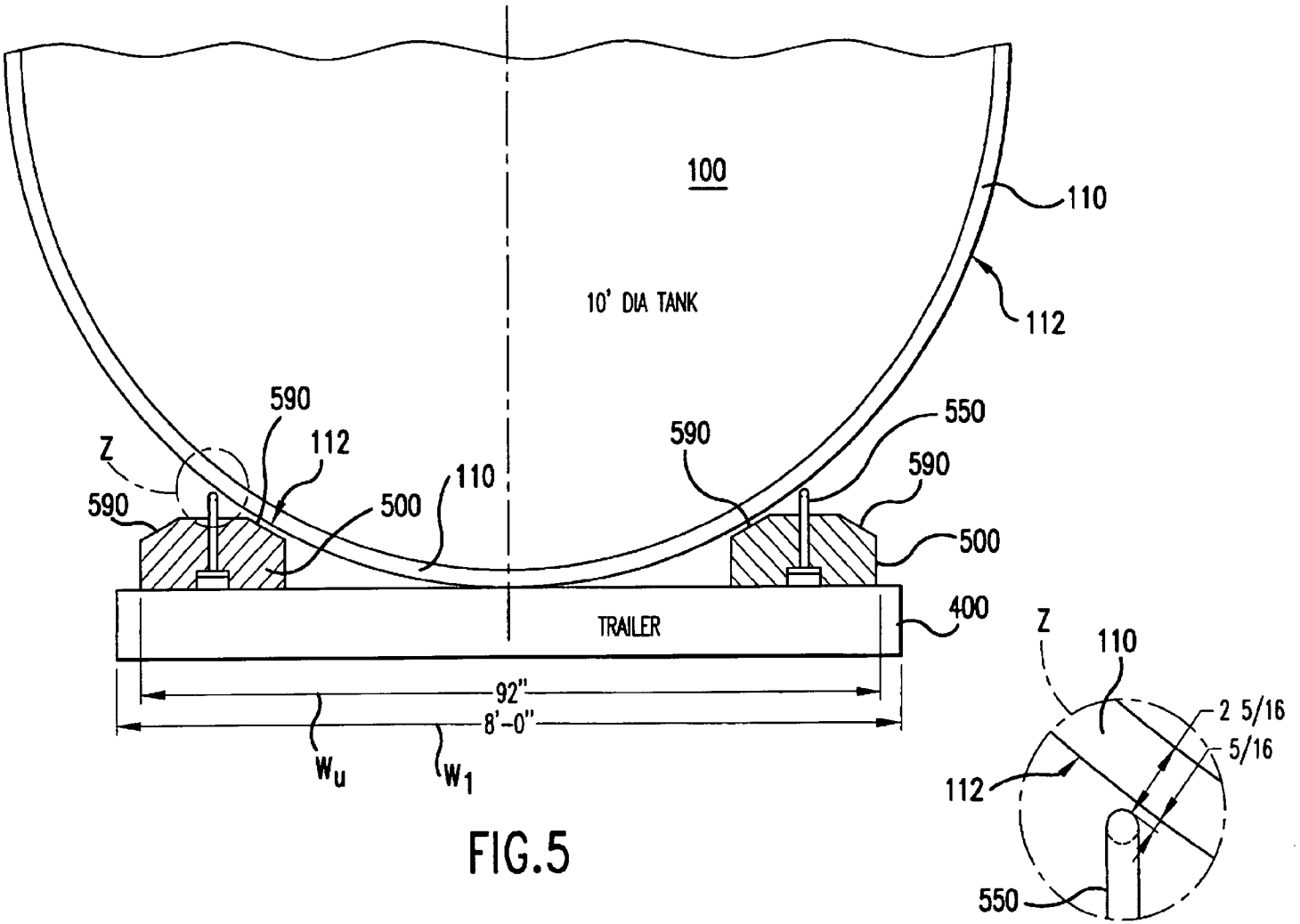
FIG. 5 is a schematic end view of the storage tank of FIG. 1 loaded onto a conventional flatbed trailer along with deadmen according to the preferred embodiment of the present invention.

Referring now to FIG. 5, a preferred embodiment of a deadman 500 according to the present invention is illustrated. The deadman 500 has a low profile and chamfered edges 590 that facilitate placing the deadman 500 on a trailer with the usable width $W_u$ alongside the tank 100 and still allow clearance between the top surface 112 of the ribs 110 and the deadman 500 and the "fastening loop" 550, as shown in detail section Z of FIG. 5. In addition to the reduction in shipping costs that can be achieved by shipping the deadmen 500 alongside the tank 100, the deadmen 500 is lighter in weight than conventional rectangular deadmen and the combined load can be shipped on smaller weight capacity tractor trailers ("hot shots").

In preferred embodiments, the deadman 500 has a low profile with a height that is less than the width of the deadman. The low profile combined with the chamfered edges allows the deadman to be placed on the trailer alongside the tank.

Figure 6A:
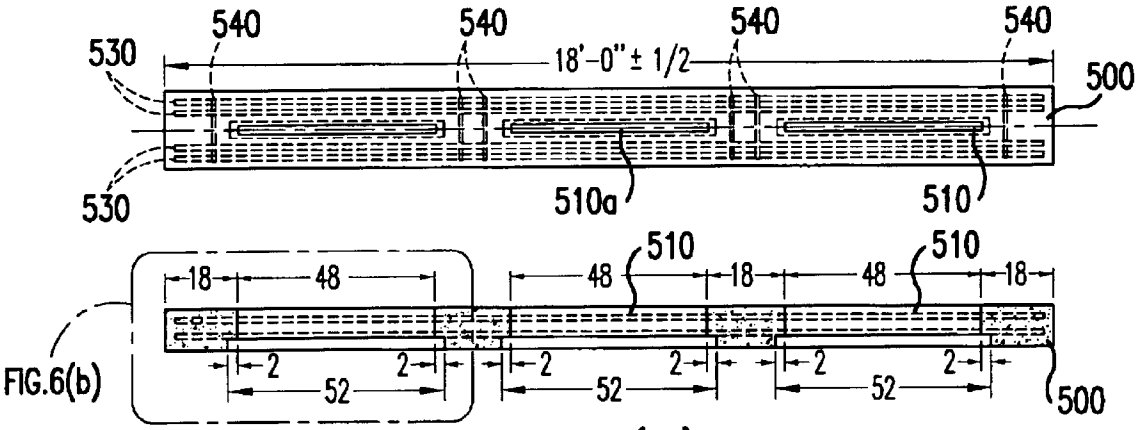
FIGS. 6(*a*) and (*b*) are top and side views, respectively, of one of the deadmen of FIG. 5.
Figure 6B:
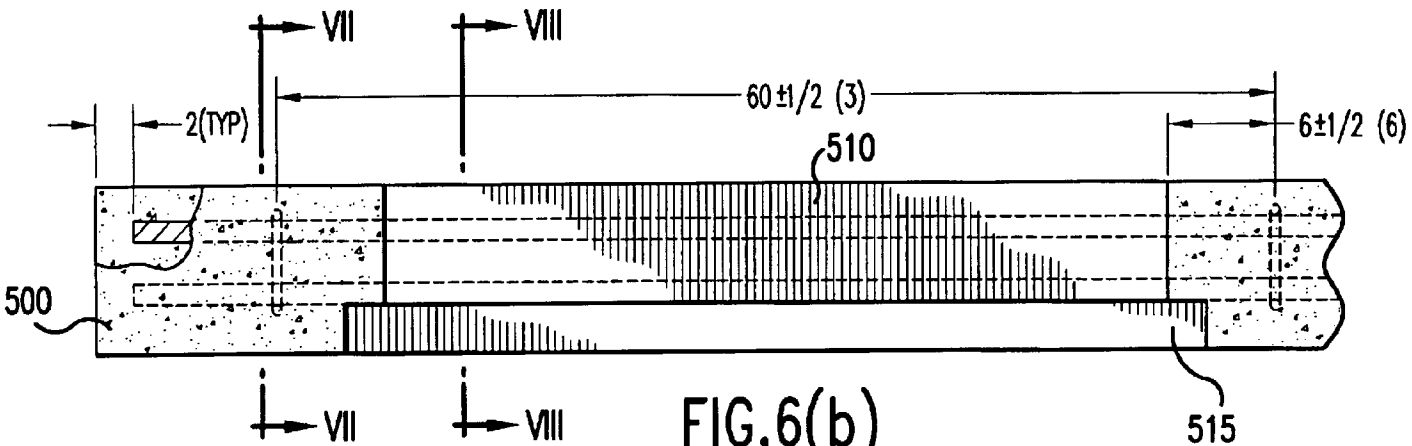
Figure 7:
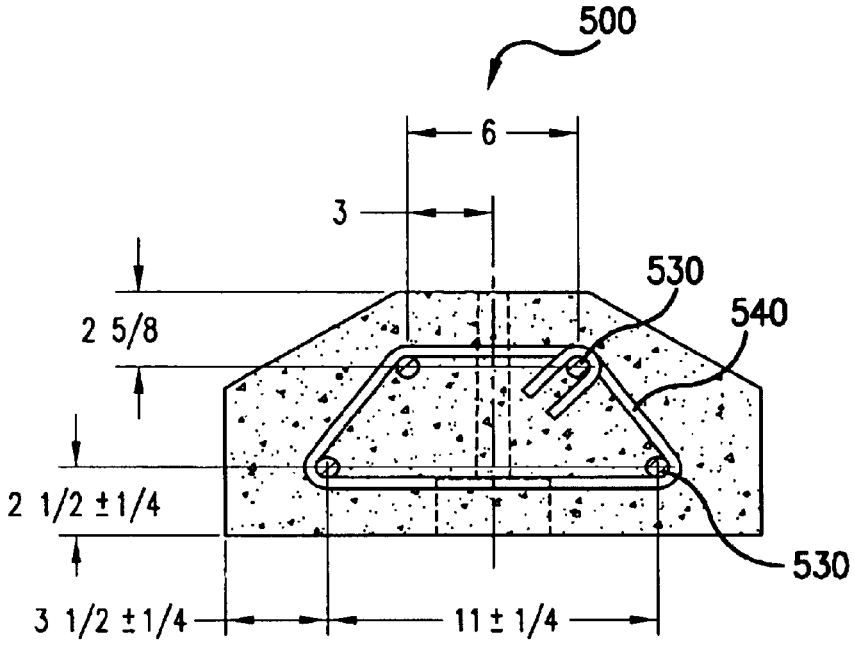
FIG. 7 is a cross sectional view of the deadman of FIG. 6 taken along the line VII—VII of FIG. 6(*b*).
Figure 8:
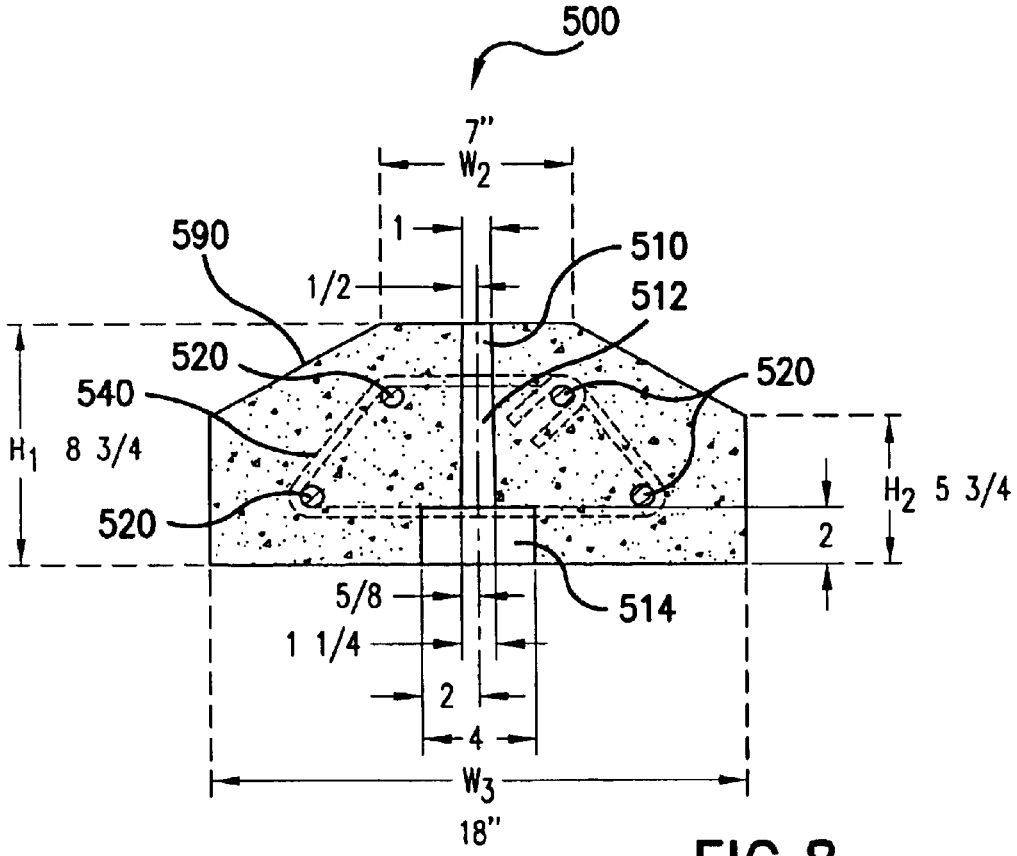
FIG. 8 is a cross sectional view of the deadman of FIG. 6 taken along the line VIII—VIII of FIG. 6(*b*).
Figure 9A:
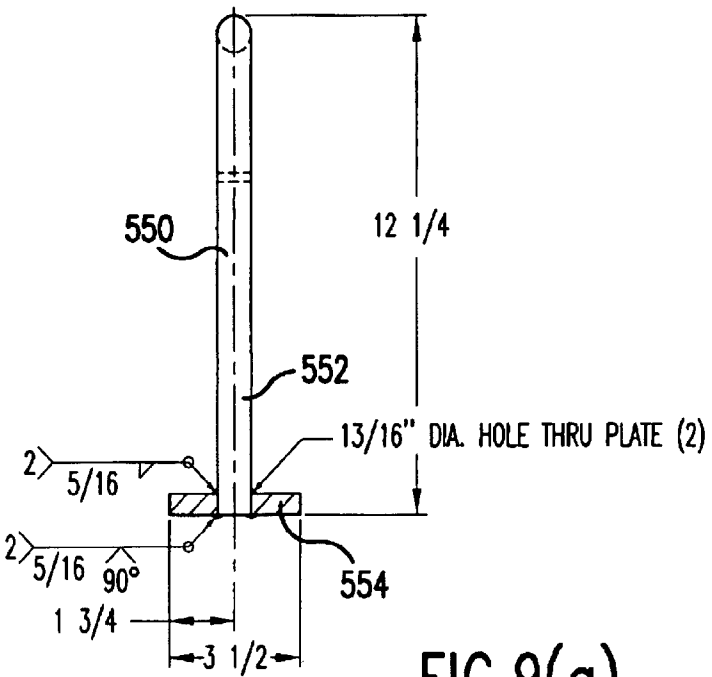
FIGS. 9(*a*) and (*b*) are cross sectional end and side views, respectively, of a fastening loop according to the present invention.
Figure 9C:
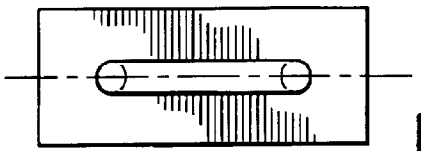
Figure 9B:
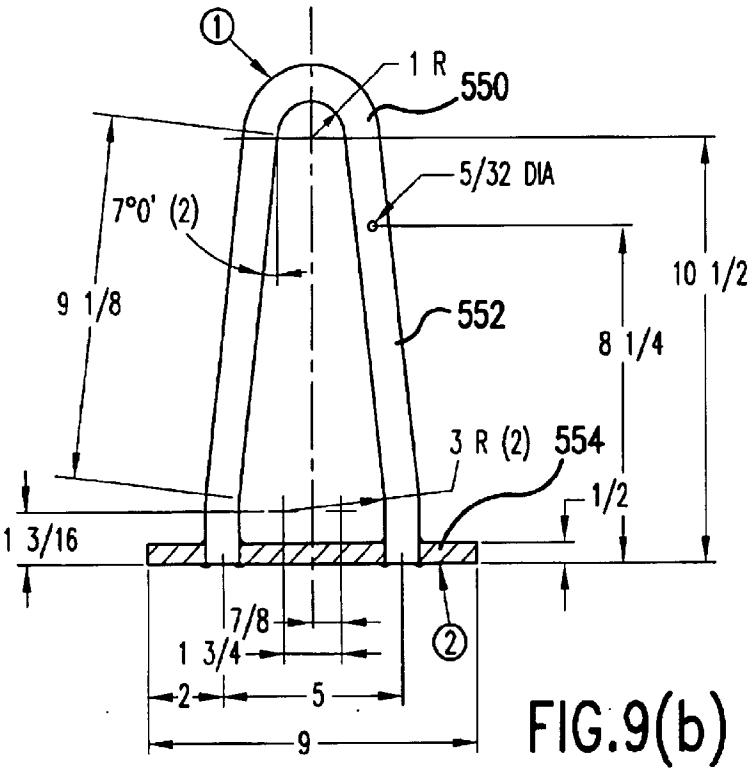

FIGS. 6, 7 and 8 illustrate the deadman 500 of FIG. 5 in further detail. FIGS. 6(*a*) and (*b*) are top and side views, respectively, of the deadman 500. The deadman includes a plurality of slots 510. As will be discussed in further detail below, the slots 510 accommodate "fastening loops" of the style of FIG. 9. Also shown in FIG. 6(*a*) (in phantom) are a plurality of reinforcing bars 530 and stirrups 540. Referring now to FIG. 7, which is a cross sectional view of the deadman 500 taken along the line VII—VII of FIG. 6(*b*), the reinforcing bars 530 and stirrups 540 are arranged to form a frame for the deadman 500. The stirrups 540 are preferably formed from a single piece of reinforcing bar bent in the shape shown in FIG. 7. In some preferred embodiments, the reinforcing bars 530 are grade 60 steel while the stirrups 540 are formed from grade 40 steel reinforcing bars to allow for easier bending.

Figure 10:
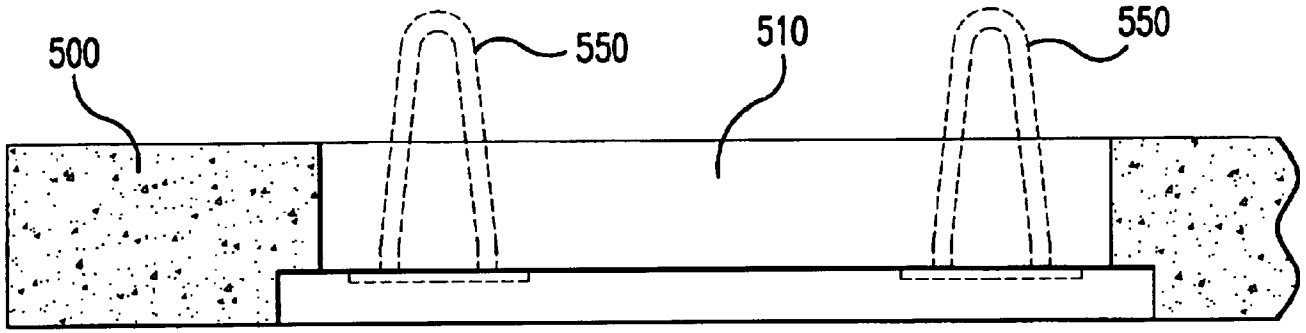
FIG. 10 is a longitudinal (side view) of a portion of the deadman of FIG. 6.
Figure 11C:
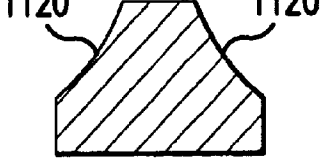
FIGS. 11(*a*)–(*d*) are cross sectional end views of deadman according to alternative embodiments of the present invention.
Figure 11B:
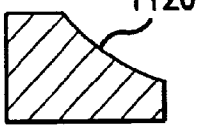
Figure 11A:
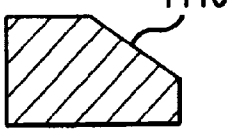
Figure 11D:
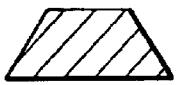

FIG. 8 is a cross sectional diagram of the deadman 500 taken along the line VIII—VIII of FIG. 6(*b*) with the stirrups 540 shown in phantom for reference. The deadman 500 includes a slot 510 with a tapered upper portion 512 and a wide lower portion 514. The slot 510 accommodates a "fastening loop" such as the fastening loop 550 illustrated in FIG. 9. The fastening loop 550 includes a curved portion 552 connected to a bottom plate 554. The bottom plate 554 is sized to fit into the wide portion 514 of the slot 510, while the tapered portion 512 of the slot 510 is sized to allow the curved portion 552 of the loop 550 to pass through and extend beyond the top surface of the deadman 500. Because the slots 510 in the deadman 500 are elongated as shown in FIG. 6(*a*), the loop 550 can be moved to various positions along the slot 510 as shown in phantom in FIG. 10. This movement simplifies aligning the loop 550 to, for example, the position of a strap that is to straddle an external rib on a UST as it allows the alignment to be made without requiring movement of the UST or the deadman to which the loop 550 is engaged.

In one highly preferred embodiment, the deadman 500 has a height of $H_1$ of approximately 8¾" and a width $W_1$ of approximately 18". In this embodiment, the width $W_2$ of the top surface is approximately 7" and the chamfered edge 590 begins at a height $H_2$ of approximately 5¾" from the bottom of the deadman 500. In other highly preferred embodiment, the width of the deadman is 14", which matches the width of a popular deadman currently sold by the assignee of the application, Xerxes Corporation. That embodiment is also low profile, with a height approximately equal to 9".

Although the preferred embodiments of deadman described above have a rectangular cross sectional shape with two chamfered edges, it should be understood that other shapes are also possible. In one alternative embodiment, the deadman has a rectangular cross sectional shape with only one chamfered edge 1110 as shown in FIG. 11(*a*). In another alternative embodiment, shown in FIG. 11(*b*), the deadman includes a curved face 1120 with a radius of curvature that is roughly equal to the radius of curvature of the tank (for tanks with exterior ribs, the radius of curvature of the deadman is roughly equal to the radius of curvature of the outermost surface of the rib) with which the deadman is to be used. In still another alternative embodiment, the deadman includes two curved faces 1120 as shown in FIG. 11(*c*). In yet another embodiment, the deadman has a generally trapezoidal cross sectional shape as shown in FIG. 11(*d*). Other cross-sectional shapes are also possible.

Obviously, numerous modifications and variations of the present invention are possible in light of the above teachings. It is therefore to be understood that within the scope of the appended claims, the invention may be practiced otherwise than as specifically described herein.

What is claimed is:

1. A method for shipping an underground storage tank and a deadman, the method comprising the steps of:

providing a flatbed trailer having a width approximately equal to ninety six inches;

placing the underground storage tank having a diameter approximately equal to ten feet on the flatbed trailer;

placing a first deadman on the trailer in a position alongside the tank, the deadman having a non-rectangular cross-sectional shape; and transporting the tank and the deadman to a desired destination.

2. The method of claim 1, further comprising the steps of:

placing a second deadman on the trailer alongside the tank, the second deadman having a non-rectangular cross-sectional shape.

3. The method of claim 2, wherein the second deadman is placed on a side of the tank opposite from the first deadman.

4. The method of claim 3, wherein each of the deadmen includes a chamfered edge.

5. The method of claim 3, wherein each of the deadmen includes two chamfered edges.

6. The method of claim 3, wherein at least one portion of each deadman has a cross sectional shape including a substantially flat upper surface; a substantially flat lower surface substantially parallel to the upper surface, the lower surface being wider than the upper surface, and at least one linear surface connected to the top surface at a non-normal angle.

7. The method of claim 3, wherein at least one portion of each of deadman has a cross sectional shape including a substantially flat upper surface; a substantially flat lower surface substantially parallel to the upper surface, the lower surface being wider than the upper surface, and at least one linear surface connected to the bottom surface at a non-normal angle.

8. The method of claim 3, wherein at least one portion of each deadman has a cross sectional shape including a substantially flat upper surface, a substantially flat lower surface substantially parallel to the upper surface, the lower surface being wider that the upper surface, and at least one curved surface connected to the top surface.

9. The method of claim 3, wherein at least one portion of each deadman has a cross sectional shape including a substantially flat bottom surface and at least one curved side surface.

10. The method of claim 3, wherein at least one portion of each deadman has a cross sectional shape including a bottom surface and at least one side surface connected to the bottom surface at a non-normal angle.

11. The method of claim 3, wherein each deadman has a width of approximately eighteen inches.

12. The method of claim 3, wherein each deadman has a width of approximately fourteen inches.

13. A shipping assembly comprising:

a flatbed trailer having a width of approximately ninety six inches;

an underground storage tank on the flatbed trailer, the tank having a generally cylindrical body with a diameter of approximately ten feet;

a first deadman on the trailer, the first deadman being positioned on a first side of the tank; and a second deadman on the trailer, the second deadman being positioned on a second side of the tank;

wherein each of the deadmen has at least one chamfered edge, the chamfered edge being in a position facing the tank.

14. The shipping assembly of claim 13, wherein each of the deadman has a width of approximately eighteen inches.

15. The shipping assembly of claim 13, wherein the deadman has a width of approximately fourteen inches.

16. The shipping assembly of claim 13, wherein the deadman has a height that is less than a width of the deadman.

* * * * *